United States Patent [19]

Osawa et al.

[11] Patent Number: 4,981,122

[45] Date of Patent: Jan. 1, 1991

[54] FUEL INJECTION CONTROL DEVICE OF AN ENGINE

[75] Inventors: Kouichi Osawa; Hiroshi Kanai; Kouichi Hoshi; Hiroki Matsuoka, all of Susono; Michihiro Ohashi, Mishima; Yukihiro Sonoda, Susono; Hiroshi Sawada, Gotenba, all of Japan

[73] Assignee: Toyota Jidosha Kabushiki Kaisha, Toyota, Japan

[21] Appl. No.: 470,180

[22] Filed: Jan. 25, 1990

[30] Foreign Application Priority Data

Jan. 27, 1989 [JP] Japan ..... 1-16343

[51] Int. Cl.[5] ..... F02D 41/14

[52] U.S. Cl. ..... 123/325; 123/489; 123/492; 123/493

[58] Field of Search ..... 123/325, 326, 493, 492, 123/489

[56] References Cited

U.S. PATENT DOCUMENTS

| | | | |
|---|---|---|---|
| 4,416,237 | 11/1983 | Aoki et al. | 123/438 |
| 4,499,882 | 2/1989 | Saito et al. | 123/492 |
| 4,616,619 | 10/1986 | Saito et al. | 123/489 |
| 4,633,840 | 1/1987 | Saito et al. | 123/489 |
| 4,635,200 | 1/1987 | Egami et al. | 364/431.05 |
| 4,667,631 | 5/1987 | Kinugasa | 123/325 |
| 4,697,559 | 10/1987 | Suzuki et al. | 123/325 |

FOREIGN PATENT DOCUMENTS

| | | | |
|---|---|---|---|
| 57-18440 | 1/1982 | Japan . | |
| 58-104335 | 6/1983 | Japan . | |
| 58-104336 | 6/1983 | Japan . | |
| 60-1346 | 1/1985 | Japan . | |
| 60-17237 | 1/1985 | Japan . | |
| 60-116836 | 6/1985 | Japan . | |
| 1-138345 | 5/1989 | Japan | 123/489 |

*Primary Examiner*—Andrew M. Dolinar
*Attorney, Agent, or Firm*—Kenyon & Kenyon

[57] ABSTRACT

A fuel injection control device in which the supply of fuel into the engine cylinder is stopped at the time of deceleration, and a rich time of the air-fuel mixture is calculated when the supply of fuel is stopped. If the rich time becomes relatively long, the accelerating increasing rate of the amount of fuel is increased, and if the rich time becomes relatively short, the accelerating increasing rate of the amount of fuel is reduced.

25 Claims, 12 Drawing Sheets

FUEL INJECTION CONTROL DEVICE OF AN ENGINE

BACKGROUND OF THE INVENTION

1. Field of the Invention

The present invention relates to a fuel injection control device of an engine.

2. Description of the Related Art

2. Description

In a fuel injection type engine, the basic amount of fuel injected by a fuel injector is usually calculated from the engine speed and the level of vacuum in the intake passage or from the engine speed and the amount of air fed into the engine cylinder, and the actual amount of fuel injected by the fuel injector is feedback controlled so that the air-fuel ratio of mixture fed into the engine cylinder becomes equal to a predetermined desired air-fuel ratio, for example, the stoichiometric air-fuel ratio, by correcting the basic amount of fuel on the basis of the output signal of the oxygen concentration detector (hereinafter referred to as an $O_2$ sensor) arranged in the exhaust passage of the engine. Nevertheless, even if such a feedback control is carried out, when the amount of fuel injected by the fuel injector is abruptly increased as at the time of acceleration, the amount of fuel adhering to the inner wall of the intake port in the form of a liquid fuel is increased, and since this liquid fuel is not fed into the engine cylinder immediately after adhering to the inner wall of the intake port, the air-fuel mixture fed into the engine cylinder temporarily becomes lean. Conversely, when the engine is decelerated, the absolute pressure in the intake port becomes low, and as a result, since the amount of vaporization of the liquid fuel adhering to the inner wall of the intake port is increased, the air-fuel mixture fed into the engine cylinder temporarily becomes rich.

Consequently, in a fuel injection type engine, the amount of fuel injected by the fuel injector is usually increased at the time of an acceleration and decreased at the time of a deceleration, so that the air-fuel ratio of mixture fed into the engine cylinder becomes equal to a desired air-fuel ratio, for example, the stoichiometric air-fuel ratio, even if the engine is operating in a transition state such as an acceleration state and a deceleration state. Consequently, in such a fuel injection type engine, the air-fuel ratio of the mixture fed into the engine cylinder is controlled so that it becomes approximately equal to the desired air-fuel ratio, regardless of the operating state of the engine.

Nevertheless, in such a fuel injection type engine, blowby gas and lubricating oil for example, pass through the clearance between the valve stem and the stem guide of the intake valve and flow into the intake port, and thus, when the engine is run for a long time, carbon particles, etc., contained in the blowby gas and the lubricating oil are gradually deposited on the inner wall of the intake port and the rear face of the valve head of the intake valve. These deposited carbon particles, i.e., the carbon deposit, have a physical characteristic of retaining liquid fuel, and thus, if the carbon deposit is deposited on the inner wall of the intake port etc., the amount of liquid fuel adhering to the inner wall of the intake port, etc., is increased, and this increases the time taken by the liquid fuel to flow into the engine cylinder after the liquid fuel adheres to the inner wall of the intake port, etc. Consequently, although the air-fuel ratio of mixture fed into the engine cylinder can be controlled so that it becomes approximately equal to the stoichiometric air-fuel ratio, regardless of the engine operating state, while the engine is relatively new, if the deposit is deposited on the inner wall of the intake port, etc., after the engine has been run for a long time, since the time taken by the liquid fuel to flow into the engine cylinder is increased, as mentioned above, the air-fuel mixture fed into the engine cylinder becomes lean at the time of acceleration. In addition, since the amount of liquid fuel adhering to the inner wall of the intake port, etc., is increased, the air-fuel mixture fed into the engine cylinder becomes rich at the time of deceleration. At this time, since the amount of the deposit is increased, the air-fuel mixture becomes even leaner at the time of acceleration and even richer at the time of deceleration. In this case, for example, the leaner the air-fuel mixture at the time of acceleration, the longer the time during which the air-fuel mixture remains lean.

Consequently, in a known fuel injection type engine, the time during which the air-fuel mixture becomes lean (hereinafter referred to as a lean time) within a fixed time after the accelerating operation of the engine is started, and the time during which the air-fuel mixture becomes rich (hereinafter referred to as a rich time) within the fixed time after the accelerating operation is started are calculated, and the acceleration increase in the amount of fuel fed by the fuel injector is corrected on the basis of the lean time and the rich time, so that the air-fuel ratio of the mixture fed into the engine cylinder becomes a desired air-fuel ratio even if the accelerating operation of the engine is carried out (see U.S. Pat. No. 4499882).

Nevertheless, various patterns of the accelerating operation of the engine exist, and at the time of a typical accelerating operation wherein the depression of the accelerator pedal is maintained at a constant level after the accelerator pedal is depressed, if there is carbon deposited on the inner wall of the intake port, etc., the lean time becomes long and it is possible to thereby detect the presence of the deposit when using the above-mentioned known fuel injection type engine. Nevertheless, in practice, such a typical accelerating operation is not always carried out and, for example, when the engine speed becomes high after the accelerator pedal is depressed, the depression of the accelerator pedal is often reduced. When the depression of the accelerator pedal is reduced, the amount of fuel injected by the fuel injector is controlled so that it is reduced, but at this time, if the deposit is adhered to the inner wall of the intake port, etc., the air-fuel mixture sometimes remains rich, causing a wrong determination that the air-fuel mixture is rich at the time of acceleration. As mentioned above, in practice, various patterns of the transition states exist, and the lean time or the rich time becomes long in accordance with a prevailing pattern of the transition state. Consequently, even if the lean time and the rich time are compared within a fixed time after the accelerating operation is started, as in the above-mentioned known fuel injection type engine, it is difficult to correctly determine whether or not the air-fuel mixture has actually become lean.

SUMMARY OF THE INVENTION

An object of the present invention is to provide a fuel injection control device capable of equalizing the air-fuel ratio of the mixture with a desired air-fuel ratio at the time of acceleration.

Therefore, according to the present invention, there is provided a fuel injection control device of an engine having an intake passage and an exhaust passage, the device comprising: an oxygen concentration detector arranged in the exhaust passage and producing an output signal indicating whether an air-fuel mixture fed into the engine is lean or rich; feedback control means for controlling an amount of fuel fed into the engine in response to the output signal of the oxygen concentration detector, to bring an air-fuel ratio of the mixture to a desired air-fuel ratio; acceleration detecting means for detecting an accelerating operation of the engine; fuel increasing means for increasing the amount of fuel fed into the engine when the accelerating operation of the engine is carried out; deceleration detecting means for detecting a decelerating operation of the engine; fuel supply stopping means for stopping a supply of fuel into the engine when the decelerating operation of the engine is carried out; time calculating means for calculating a rich time of the air-fuel mixture on the basis of the output signal of the oxygen concentration detector during the time for which the supply of fuel is stopped; and correction means for correcting an increase in the amount of fuel, which increase is caused by the fuel increasing means, to increase the increase in the amount of fuel when the rich time is longer than a predetermined first time and to reduce the increase in the amount of fuel when the rich time is shorter than a predetermined second time, which is shorter than the first predetermined time.

The present invention may be more fully understood from the description of a preferred embodiment of the invention set forth below, together with the accompanying drawings.

DESCRIPTION OF A PREFERRED EMBODIMENT

Figure 1:
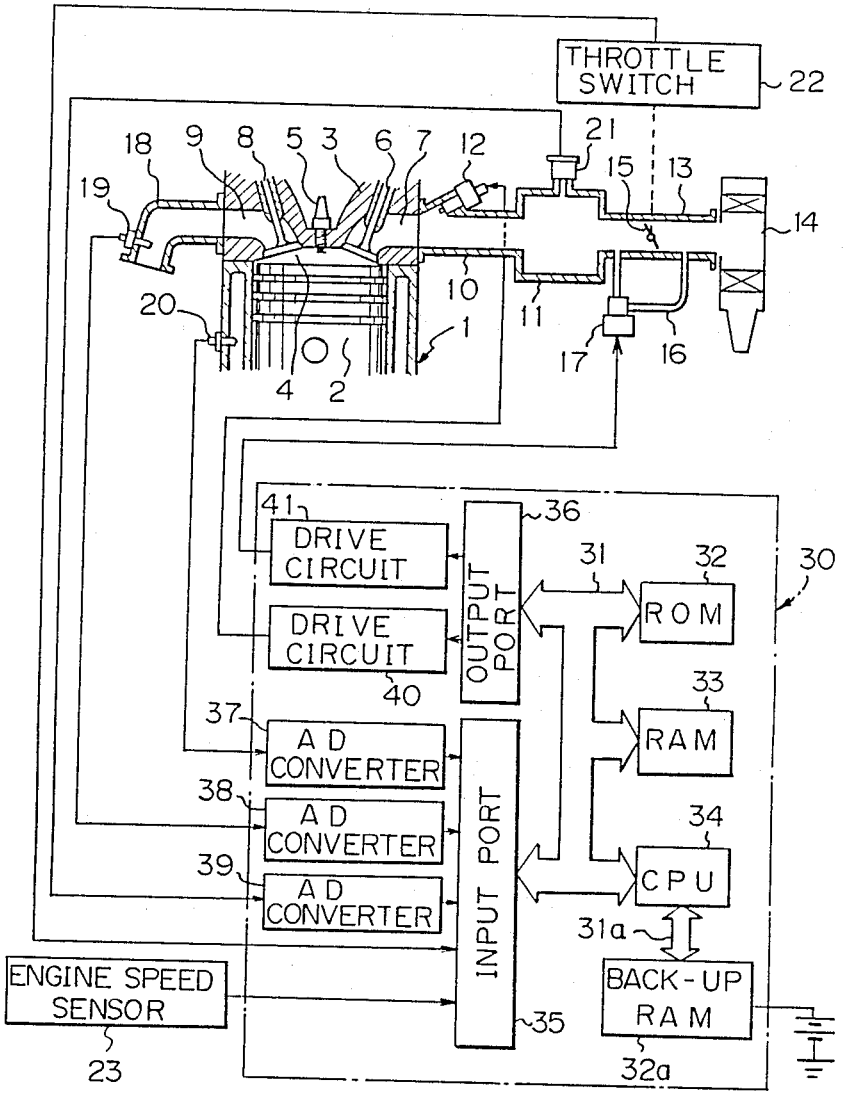
FIG. 1 is a schematically illustrated view of an engine.

Referring to FIG. 1, reference numeral 1 designates an engine body, 2 a piston, 3 a cylinder head, and 4 a combustion chamber formed between the piston 2 and the cylinder head 3; 5 designates a spark plug, 6 an intake valve, 7 an intake port, 8 an exhaust valve, and 9 an exhaust port. The intake port 7 is connected to a surge tank 11 via a corresponding branch pipe 10, and a fuel injector 12 is mounted on the branch pipe 10 to inject fuel into the corresponding intake port 7. The fuel injecting operation by the fuel injector 12 is controlled by a signal output by an electronic control unit 30. The surge tank 11 is connected to an air cleaner 14 via an intake duct 13, and a throttle valve 15 is arranged in the intake duct 13. A bypass passage 16 bypassing the throttle valve 15 is connected to the intake duct 13, and a bypass air control valve 17 is arranged in the bypass passage 16. The exhaust port 9 is connected to an exhaust manifold 18, and an 02 sensor 19 is arranged in the exhaust manifold 18.

The electronic control unit 30 is constructed as a digital computer and comprises a ROM (read only memory) 32, a RAM (random access memory) 33, a CPU (microprocessor, etc.) 34, an input port 35, and an output port 36. The ROM 32, the RAM 33, the CPU 34, the input port 35 and the output port 36 are interconnected via a bidirectional bus 31. A back-up RAM 32*a* is connected to the CPU 34 via a bus 31*a*.

A coolant temperature sensor 20 producing an output voltage proportional to the engine cooling water temperature is mounted on the engine body 1, and the output voltage of the coolant temperature sensor 20 is input to the input port 35 via an AD converter 37. The output voltage of the $O_2$ sensor 19 is also input to the input port 35 via an AD converter 38. An absolute pressure sensor 21 producing an output voltage proportional to the absolute pressure in the surge tank 11 is arranged in the surge tank 11, and the output voltage of the absolute pressure sensor 21 is input to the input port 35 via an AD converter 39. A throttle switch 22 is attached to the throttle valve 15, to detect whether the throttle valve 15 is fully closed, and the output signal of the throttle switch 22 is input to the input port 35. An engine speed sensor 23 produces an output pulse each time the crankshaft (not shown) is rotated by a predetermined crankangle, and the output pulse of the engine speed sensor 23 is input to the input port 35. The engine speed is calculated from this output pulse, in the CPU 34. The output port 36 is connected to the fuel injector 12 and the bypass air control valve 17, via corresponding drive circuits 40 and 41. The bypass air control valve 17 is provided for controlling the idling speed of the engine, and the amount of the bypass air flowing within the bypass passage 16 is controlled by the bypass air control valve 17 so that the engine speed becomes equal to a desired idling speed at the time of idling.

The fuel injection time TAU of the fuel injector 12 is calculated from the following equation.

$$TAU=(TP+K\cdot TPAEW)\cdot FAF\cdot F \quad (1)$$

where

TP: basic fuel injector time

TPAEW: correction fuel injection time for transition state such as an accelerating state and a decelerating state K: correction coefficient of the correction fuel injection time TPAEW for the deposit FAF: feedback correction coefficient F: correction coefficient determined by the temperature of the engine cooling water and the temperature of air fed into the engine cylinder etc.

The basic fuel injection time TP is calculated from the engine speed NE and the absolute pressure PM in the surge tank 11. The relationship between the basic fuel injection time TP and the absolute pressure PM, the engine speed NE is experimentally determined so that the air-fuel ratio of the fuel and air mixture fed into the engine cylinder becomes equal to a desired air-fuel ratio, for example, the stoichiometric air-fuel ratio, when fuel is injected from the fuel injector 12 by the basic fuel injection time TP in a cruising operating state of the engine, and this relationship is stored in the ROM 32. Consequently, when the cruising operation of the engine is carried out, if fuel is injected from the fuel injector 12 for the basic fuel injection time TP, which is calculated on the basis of the relationship, stored in the ROM 32, between the absolute pressure PM and the engine speed NE, the air-fuel ratio of the mixture fed into the engine cylinder becomes essentially approximately equal to the desired air-fuel ratio. At this time, if the type of $O_2$ sensor 19 which can detect any air-fuel ratio is used, it is possible to freely use any air-fuel ratio as the desired air-fuel ratio. Nevertheless, the present invention will be hereinafter described with regard to the case wherein the desired air-fuel ratio is the stoichiometric air-fuel ratio, so that the present invention can be easily understood. In this case, if fuel is injected from the fuel injector 12 for the basic fuel injection time TP, the air-fuel ratio of the mixture fed into the engine cylinder becomes essentially approximately equal to the stoichiometric air-fuel ratio.

When the engine operating state is not a transition state, i.e., when the cruising operation of the engine is carried out, the correction fuel injection time TPEAW becomes equal to zero. Consequently, at this time, the above-mentioned equation (1) can be represented as follows.

$$TAU = TP \cdot FAF \cdot F \quad (2)$$

Namely, at this time, the fuel injection time TAU is determined by the basic fuel injection time TP, the feedback correction coefficient FAF, and the correction coefficient F. In this case, the correction coefficient F is determined by the temperature of the engine cooling water and the temperature of air fed into the engine cylinder, etc. For example, this correction coefficient F becomes more than 1.0 before the completion of a warm-up period of the engine, wherein the cooling water temperature is low, and this correction coefficient F becomes equal to 1.0 or nearly 1.0 after the completion of a warm-up of the engine. In addition, the feedback correction coefficient FAF changes in response to the output signal of the $O_2$ sensor 19, so that the air-fuel ratio of mixture fed into the engine cylinder becomes equal to the stoichiometric air-fuel ratio.

Next, the feedback correction coefficient FAF will be described.

The $O_2$ sensor 19 produces an output voltage of about 0.1 volt when the air-fuel ratio of the mixture fed into the engine cylinder is higher than the stoichiometric air-fuel ratio, i.e., when the air-fuel mixture is lean, and the $O_2$ sensor 19 produces an output voltage of about 0.9 volt when the air-fuel ratio of the mixture is lower than the stoichiometric air-fuel ratio, i.e., when the air-fuel mixture is rich. Consequently, it can be determined, on the basis of the output signal of the $O_2$ sensor 19, whether the air-fuel mixture is lean or rich.

Figure 2:
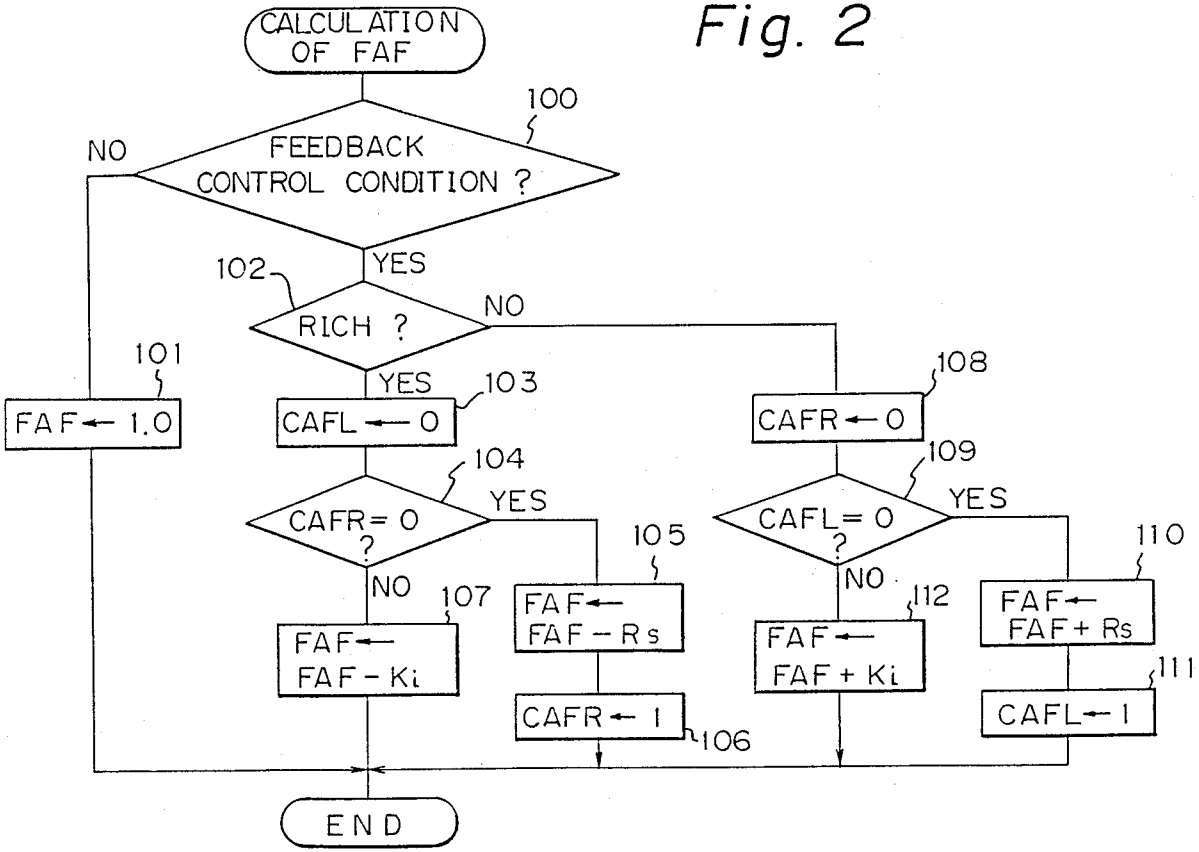
FIG. 2 is a flow chart for calculating the feedback correction coefficient FAF.

FIG. 2 illustrates a routine for calculating the feedback correction coefficient FAF on the basis of the signal output by the $O_2$ sensor 19.

Figure 3:
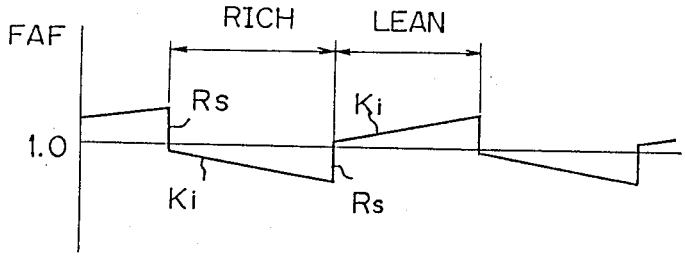
FIG. 3 is a diagram illustrating a change in the feedback correction coefficient FAF.

Referring to FIG. 3, in step 100 it is determined whether or not the feedback control condition is satisfied. Namely, it is determined that the feedback control condition is satisfied when the operating state of the engine is not an engine starting state and when the temperature of the engine cooling water is higher than a predetermined temperature. When the feedback control condition is not satisfied, the routine goes to step 101 and the feedback control coefficient FAF becomes 1.0. Consequently, when the feedback control condition is not satisfied and when the cruising operation of the engine is carried out, the fuel injection time is calculated from the following equation.

$$TAU = TP \cdot F$$

When it is determined that the feedback control condition is satisfied, the routine goes to step 102 and it is determined, on the basis of the $O_2$ sensor 19, whether or not the air-fuel mixture fed into the engine cylinder is rich. If the air-fuel mixture was lean in the preceding processing cycle, and if the air-fuel mixture has become rich in the present processing cycle, the routine goes to step 103 and the flag CAFL is reset. Then in step 104 it is determined whether or not the flag CAFR, which is reset when the air-fuel mixture changes from rich to lean, has been reset. When the air-fuel mixture changes from lean to rich, since the flag CAFR has been reset, the routine goes to step 105 and a predetermined skip value Rs is subtracted from the feedback control coefficient FAF. Then in step 106 the flag CAFR is set. Consequently, in the next processing cycle, the routine goes from step 104 to step 107 and a predetermined fixed value Ki ($Ki << Rs$) is subtracted from the feedback correction coefficient FAF.

When the air-fuel mixture changes from rich to lean, the routine goes to step 108 and the flag CAFR is reset Then, in step 109 it is determined whether or not the flag CAFL has been reset. At this time, since the flag CAFL has been reset, the routine goes to step 110 and the predetermined skip value Rs is added to the feedback control coefficient FAF. Then in step 111 the flag CAFL is set. Consequently, in the next processing cycle, the routine goes from step 109 to step 112 and the predetermined fixed value Ki is added to the feedback correction coefficient FAF. Consequently, the feedback correction coefficient FAF changes as illustrated in FIG. 3. When the air-fuel mixture becomes rich, the feedback control coefficient FAF becomes small and thus the fuel injection time TAU becomes short. Conversely, when the air-fuel mixture becomes lean, the feedback control coefficient FAF becomes large and thus the fuel injection time TAU becomes long. Accordingly, the air-fuel ratio of the mixture is controlled so that it becomes equal to the stoichiometric air-fuel ratio.

As mentioned above, when the cruising operation of the engine is carried out, and when the feedback control of the air-fuel ratio is carried out, the air-fuel ratio of the mixture fed into the engine cylinder is controlled so that it becomes equal to the stoichiometric air-fuel ratio. Where the fuel injection time TAU is calculated by using the above-mentioned equation (2), when the operating state of the engine is a transition state such as an acceleration state and a deceleration state, the air-fuel ratio of the mixture deviates from the stoichiometric air-fuel ratio even if the feedback control is carried out and even if a deposit is not adhered to the inner wall of the intake port, etc. Namely, when the engine is accelerated, the air-fuel mixture temporarily becomes lean, and when the engine is decelerated the air-fuel mixture temporarily becomes rich. Such a deviation of the air-fuel ratio occurring at the time of a transition state of the engine is based, on one hand, on the time lag until the fuel injecting operation is actually carried out after the calculation of the fuel injection time TAU is started, and on the other hand, on the time lag until the liquid fuel adhering to the inner wall of the intake port, etc., flows into the engine cylinder. These time lags, generated at the time of acceleration, will now be described with reference to FIGS. 4 and 5.

Figure 4:
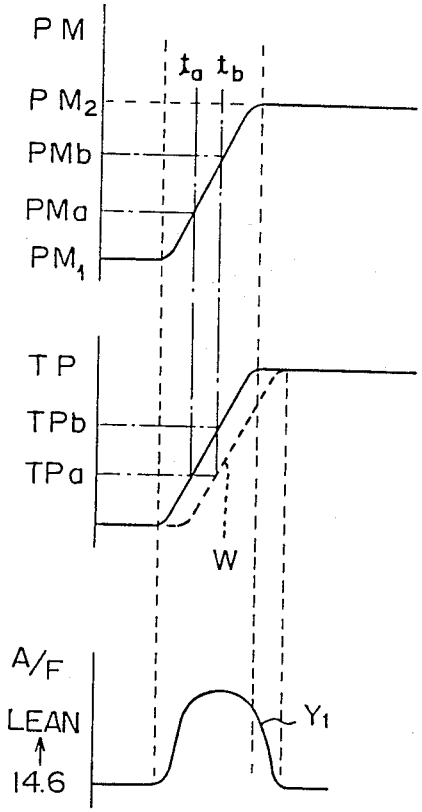
FIG. 4 is a diagram illustrating the deviation of the air-fuel ratio caused by the delay time of the actual injection.

FIG. 4 illustrates the deviation of the air-fuel ratio based on the time lag until the fuel injecting operation is actually carried out after the calculation of the fuel injection time TAU is started. As illustrated in FIG. 4, if the engine is accelerated, and thus the absolute pressure PM in the surge tank 11 is increased from $PM_1$ to $PM_2$, the basic fuel injection time TP calculated from the absolute pressure PM and the engine speed NE is increased accordingly. Assuming that the calculation of the fuel injection time TAU is started at a time $t_a$, since the absolute pressure PM is equal to PMa at this time, the basic fuel injection time TP is calculated based on PMa, and this calculated basic fuel injection time TP is defined as TPa.

The calculation of the fuel injection time TAU is usually started at a predetermined crankangle, and after the crankshaft has rotated through a predetermined angle, the actual fuel injecting operation is started. Namely, in FIG. 4, if the calculation of the fuel injection time TAU is started at a time $t_a$, the actual fuel injection is started at a time $t_b$. At the time $t_b$, however, the absolute pressure PM is increased to PMb, which is higher than PMa, and thus the basic fuel injection time TPb, which is necessary for equalizing the air-fuel ratio of the mixture with the stoichiometric air-fuel ratio at the time $t_b$, becomes longer than the basic fuel injection time TPa. Nevertheless, in the time $t_b$, since fuel is injected for only the time calculated based on the basic fuel injection time TPa, the amount of fuel actually injected by the fuel injector 12 becomes smaller than the amount of fuel necessary for equalizing the air-fuel ratio of the mixture with the stoichiometric air-fuel ratio, and thus the air-fuel mixture becomes lean. Namely, in practice, since the basic fuel injection time TP changes along the broken line W in FIG. 4, the air-fuel mixture becomes lean as illustrated by $Y_1$ during the time illustrated by the broken line W.

Figure 5:
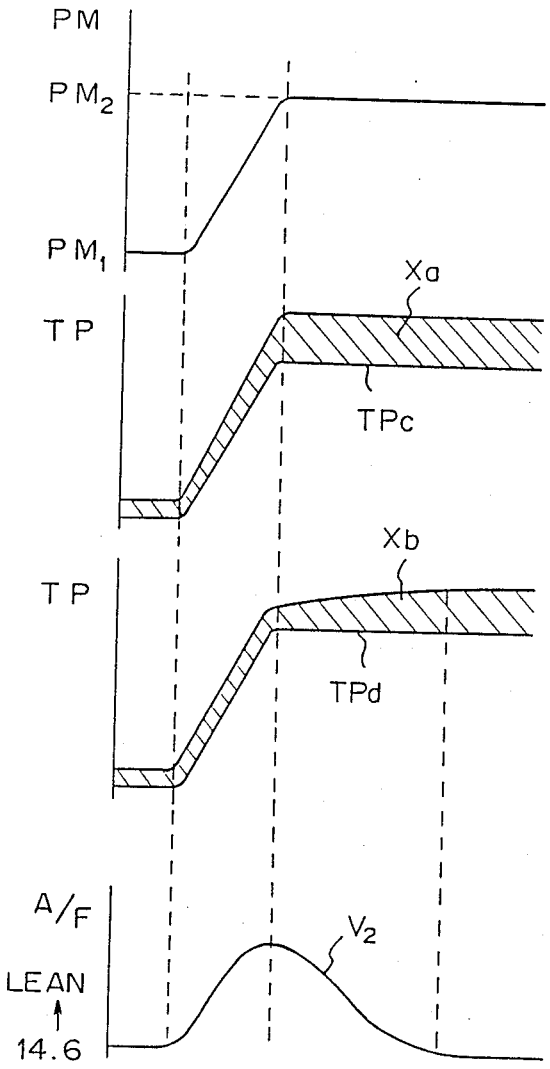
FIG. 5 is a diagram illustrating the deviation of the air-fuel ratio caused by the delay time of the actual inflow of liquid fuel into the engine cylinder.

FIG. 5 illustrates the deviation of the air-fuel ratio based on the time lag until the liquid fuel adhering to the inner wall of the intake port, etc., flows into the engine cylinder. FIG. 5 also illustrates the case wherein the absolute pressure PM is increased from $PM_1$ to $PM_2$. In FIG. 5, the curved lines TPc and TPd indicate a change in the basic fuel injection time TP, and the hatching Xa and Xb indicates the amount of liquid fuel flowing into the engine cylinder, which depends on the amount of fuel injected by the fuel injector 12, i.e., on the amount of liquid fuel adhering to the inner wall of the intake port, etc., and the amount of liquid fuel flowing into the engine cylinder is increased as the amount of fuel injected by the fuel injector 12 is increased, when the cruising operation of the engine is carried out, the amount of liquid fuel flowing into the engine cylinder is maintained at an approximately constant value, and at this time, the amount of liquid fuel flowing into the engine cylinder is increased as the engine load becomes higher. The hatching Xa illustrates the case wherein it is assumed that the amount of fuel flowing into the engine cylinder at each absolute pressure PM is the same as that when the cruising operation of the engine is carried out. In this case, also at the time of acceleration, the air-fuel ratio of mixture fed into the engine cylinder is maintained at the stoichiometric air-fuel ratio. In practice, however, when the accelerating operation of the engine is carried out, even if the amount of liquid fuel adhering to the inner wall of the intake port, etc., is increased, since all of the liquid fuel does not immediately flow into the engine cylinder, the amount of liquid fuel flowing to the engine cylinder at the time of acceleration becomes smaller than that illustrated by the hatching Xa. As the amount of liquid fuel adhering to the inner wall of the intake port, etc. is increased, the amount of liquid fuel flowing into the engine cylinder is gradually increased, and after the completion of the accelerating operation of the engine, the amount of liquid fuel flowing into the engine cylinder becomes equal to that in the cruising operation of the engine. The hatching Xb indicates the amount of liquid fuel which actually flows into the engine cylinder. Consequently, as can be seen from FIG. 5, the amount of liquid fuel Xb flowing into the engine cylinder becomes smaller than that of the amount of liquid fuel Xa flowing during the cruising operation of the engine, until some time has elapsed after the completion of the accelerating operation of the engine, and consequently, during this time the air-fuel mixture becomes lean as illustrated by $Y_2$.

Figure 6:
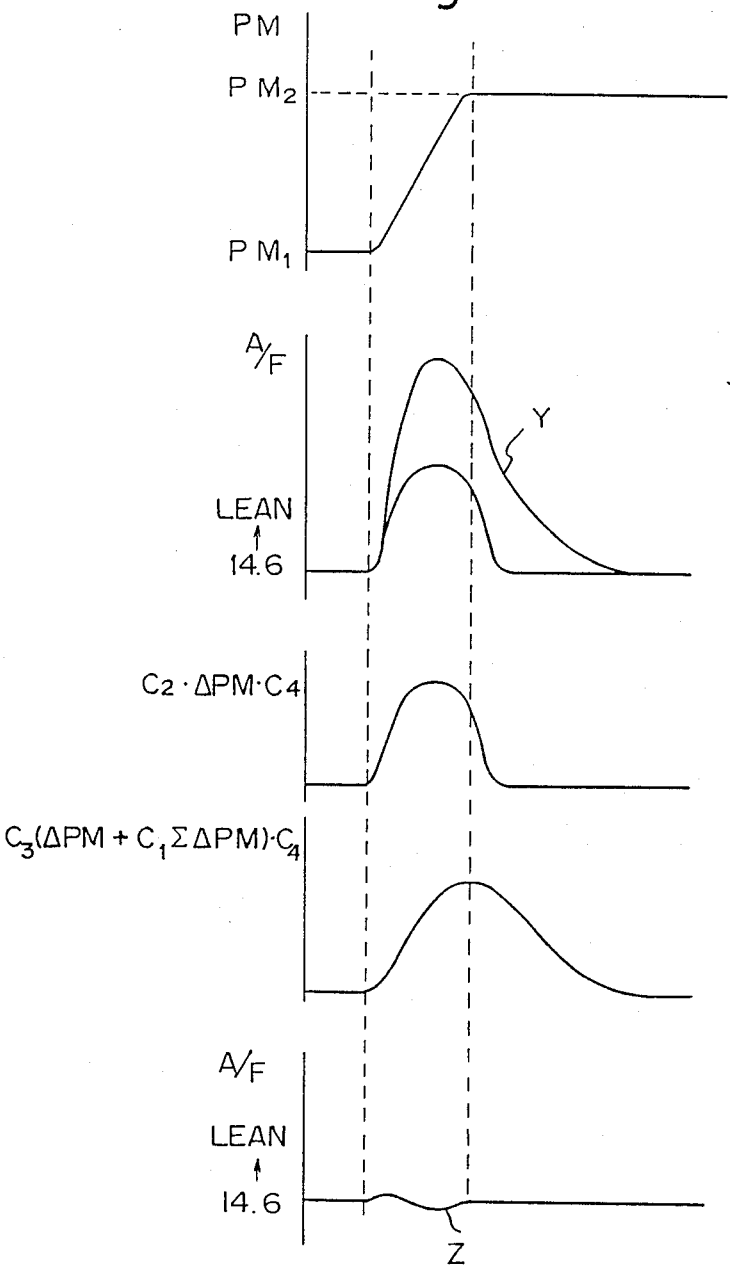
FIG. 6 is a diagram illustrating the amount of fuel to be increased or decreased at the time of acceleration.

Therefore, at the time of acceleration, as illustrated by Y in FIG. 6, the shape of the lean curve is formed by superposing the lean curve $Y_1$ on the lean curve $Y_2$. Accordingly, as illustrated in FIG. 6, if the amount of fuel injected by the fuel injector 12 is increased by an amount $C_2 \cdot \Delta PM \cdot C_4$ which corresponds to the lean curve $Y_1$, and at the same time, if the amount of fuel injected by the fuel injector 12 is increased by an amount $C_3 \cdot (\Delta PM + C_1 \cdot \Delta PM) \cdot C_4$ which corresponds to the lean curve $Y_2$, the air-fuel mixture is maintained at approximately the stoichiometric air-fuel ratio as illustrated by Z. In the above-mentioned amounts corresponding to the lean curves $Y_1$ and $Y_2$, $\Delta PM$ indicates a rate of change of the absolute pressure PM, and $C_4$ indicates a coefficient for converting the absolute pressure PM to time.

Namely, in FIG. 4, the shortage (TPb−TPa) of the basic fuel injection time TP is approximately equal to a value obtained by multiplying the time $(t_b - t_a)$ by $\Delta PM \cdot C_4$ which is at $t_a$, and if the time $(t_b - t_a)$ is represented by $C_2$, the shortage of the basic fuel injection time TP can be represented as $C_2 \cdot \Delta PM \cdot C_4$. In this case, since the time $(t_b - t_a)$ corresponds to the rotation angle of the crankshaft, $C_2$ is a function of the engine speed NE.

The curved line corresponding to the line curve $Y_2$ can be represented by $C_3 \cdot (\Delta P + C_1 \Sigma \Delta PM) \cdot C_4$. Note, $C_1$ denotes an attenuation coefficient and is smaller than 1.0. This $C_3 \cdot (\Delta P + C_1 \Sigma \Delta PM) \cdot C_4$ is calculated when calculating the fuel injection time TAU. The value of $C_3 \cdot (\Delta P + C_1 \Sigma \Delta PM) \cdot C_4$ is rapidly increased when $\Delta PM$ is large, and the value of $C_3 \cdot (\Delta P + C_1 \Sigma \Delta PM) \cdot C_4$ is gradually reduced when aPM becomes small. When the engine temperature or the temperature of air fed into the engine cylinder becomes low, the amount of liquid fuel adhering to the inner wall of the intake port, etc., is increased, and accordingly, the air-fuel mixture becomes leaner. Consequently, $C_3$ is a function of both the engine temperature and the temperature of air fed into the engine cylinder.

Therefore, if the amount of fuel injected by the fuel injector 12 is increased by an amount equal to the sum of $C_2 \cdot \Delta PM \cdot C_4$ and $C_3 \cdot (\Delta PM + C_1 \Sigma \Delta PM) \cdot C_4$ at the time of acceleration, the air-fuel mixture can be maintained at the stoichiometric air-fuel ratio. This amount of fuel to be increased at the time of acceleration represents the correction fuel injection time TPAEW in the above-mentioned equation (1), and thus TPAEW is represented as follows.

$$TPAEW = \{C_2 \cdot \Delta PM + C_3 \cdot (\Delta PM + C_1 \Sigma \Delta M)\} \cdot C_4 \quad (3)$$

In addition, where the fuel injection time TAU is calculated based on the above-mentioned equation (2), at the time of deceleration, the air-fuel mixture becomes rich and changes along the rich curves which are similar to the lean curves $Y_1$ and $Y_2$ illustrated in FIGS. 4 and 5. Consequently, at this time, if using TPAEW shown in the above-mentioned equation (3) during the calculation of the fuel injection time TAU, the air-fuel mixture fed into the engine cylinder is maintained at the stoichiometric air-fuel ratio. At this time, however, since aPM becomes negative, TPAEW also becomes negative.

Consequently, where carbon is not adhered to the inner wall of the intake port, etc., if the fuel injection time TAU is calculated by the following equation, it is possible to maintain the air-fuel mixture at the stoichiometric air-fuel ratio, regardless of the operating state of the engine.

$$TAU = (TP + TPAEW) \cdot FAF \cdot F \quad (4)$$

Figure 7:
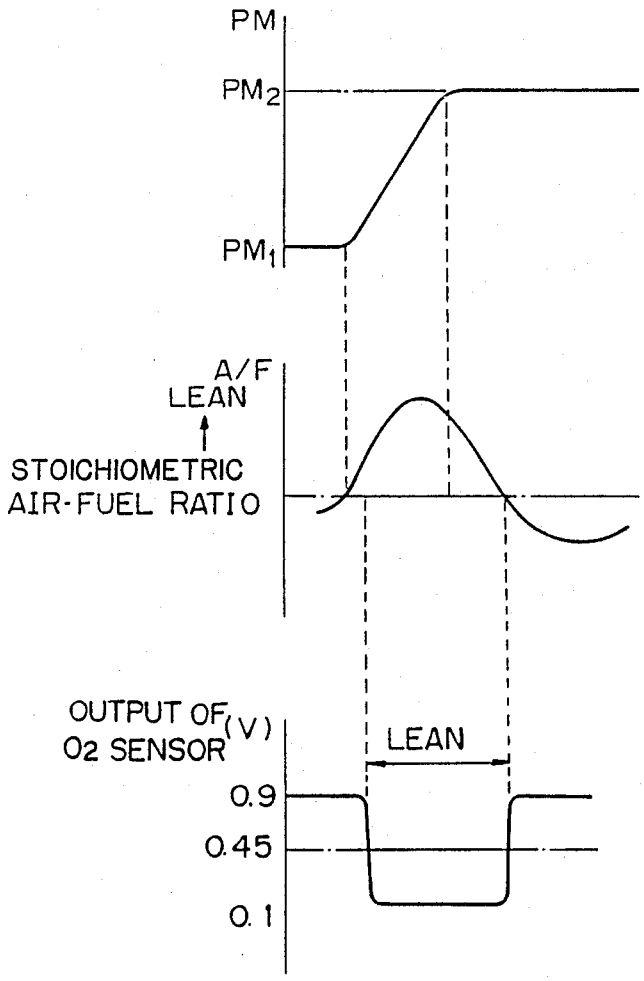
FIG. 7 is a diagram illustrating the change in the air-fuel ratio.

Nevertheless, when the engine has been used for a long time, and thus a carbon deposit is adhered to the inner wall of the intake port, etc., since this deposit has a physical characteristic of retaining liquid fuel, the amount of liquid fuel adhering to the inner wall of the intake port, etc., is increased, and thus the time required for the liquid fuel to flow into the engine cylinder is prolonged. Consequently, where the deposit is adhered to the inner wall of the intake port, etc., if the above-mentioned equation (4) is used to calculate the fuel injection time TAU, the air-fuel mixture will deviate from the stoichiometric air-fuel ratio. Namely, at the time of acceleration, since the inflow of liquid fuel to the engine cylinder is delayed due to the pressure of the deposit, the air-fuel mixture becomes lean as illustrated in FIG. 7, and at the time of deceleration, since the amount of liquid fuel adhering to the inner wall of the intake port, etc., is increased due to the presence of the deposit, the air-fuel mixture becomes rich.

Therefore, to maintain the air-fuel ratio of the mixture at the stoichiometric air-fuel ratio even if the deposit is adhered to the inner wall of the intake port, etc., the correction fuel injection time TPAEW is multiplied by the correction coefficient K, and an increase or a decrease in the amount of fuel injected by the fuel injector 12 at the time of acceleration or deceleration, respectively, is corrected by the correction coefficient K. In this case, as indicated by the above-mentioned equation (1), the fuel injection time TAU is calculated from the following equation.

$$TAU = (TP + K \cdot TPAEW) \cdot FAF \cdot F$$

Where a deposit is not adhered to the inner wall of the intake port, etc., if the supply of fuel is stopped at the time of deceleration, the air-fuel mixture becomes rich for a short time at the beginning of the decelerating operation, but thereafter, the air-fuel mixture remains lean. If the deposit is adhered to the inner wall of the intake port, etc., however, a part of fuel injected by the fuel injector is retained by the deposit, and as a result, if the supply of fuel is stopped at the time of deceleration, the liquid fuel retained by the deposit continues to be fed into the engine cylinder, and thus the air-fuel mixture temporarily remains rich. At this time, the rich time depends on both the amount of deposit and the amount of fuel injected by the fuel injector. Consequently, in the present invention, an acceleration increasing rate of the amount of fuel and a decelerating decreasing rate of the amount of fuel are determined on the basis of the rich time when the supply of fuel is stopped at the time of deceleration. Namely, in general, when the supply of fuel is stopped at the time of deceleration, if the rich time becomes relatively long, the correction coefficient K is increased, and thus the accelerating increasing rate of the amount of fuel and the decelerating decreasing rate of the amount of fuel are increased. Conversely, at this time, if the rich time becomes relatively short, the correction coefficient K is reduced, and thus the accelerating increasing rate of the amount of fuel and the decelerating decreasing rate of the amount of fuel are reduced.

Figure 8:
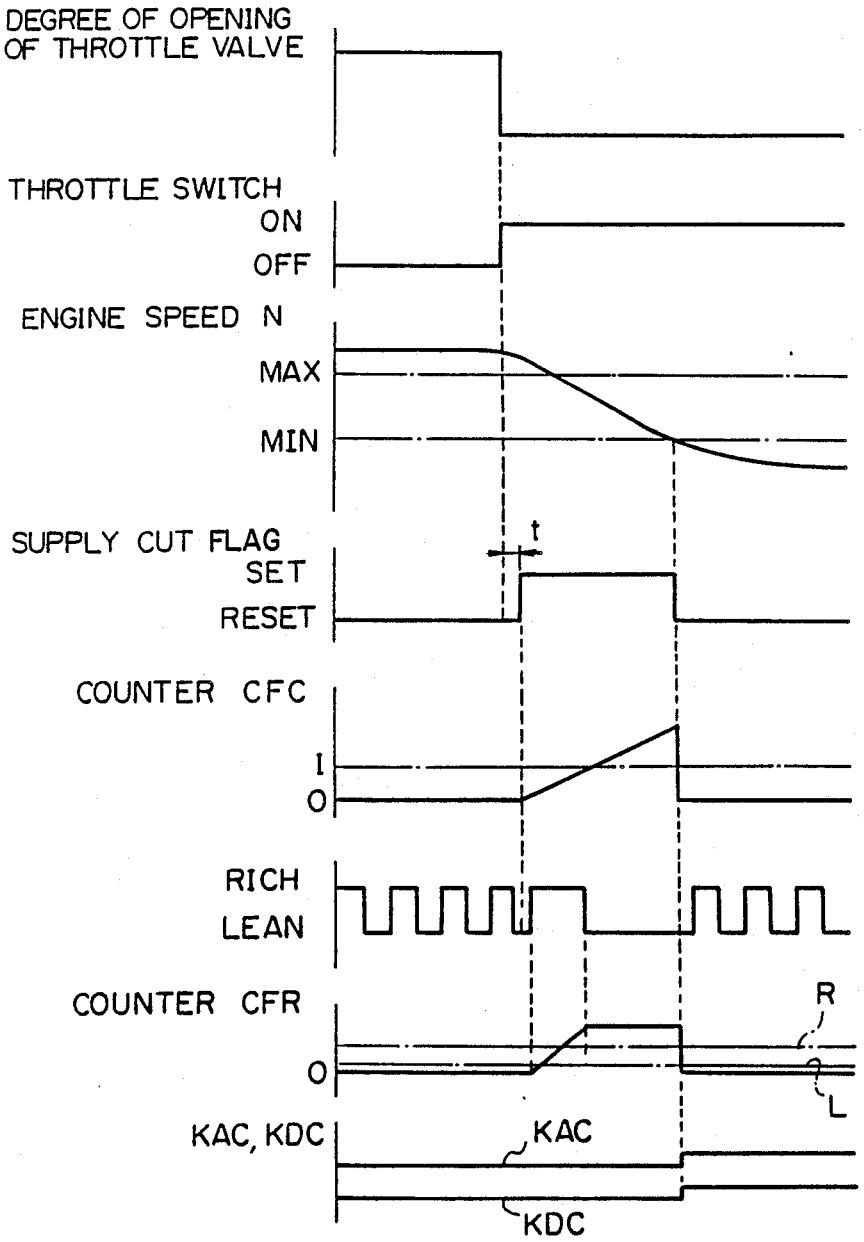
FIG. 8 is a time chart illustrating a method of calculating the deposit learning coefficient.

The fuel injection control is now described on the basis of flow charts illustrated in FIGS. 9 through 12 with reference to FIG. 8.

Figure 9:
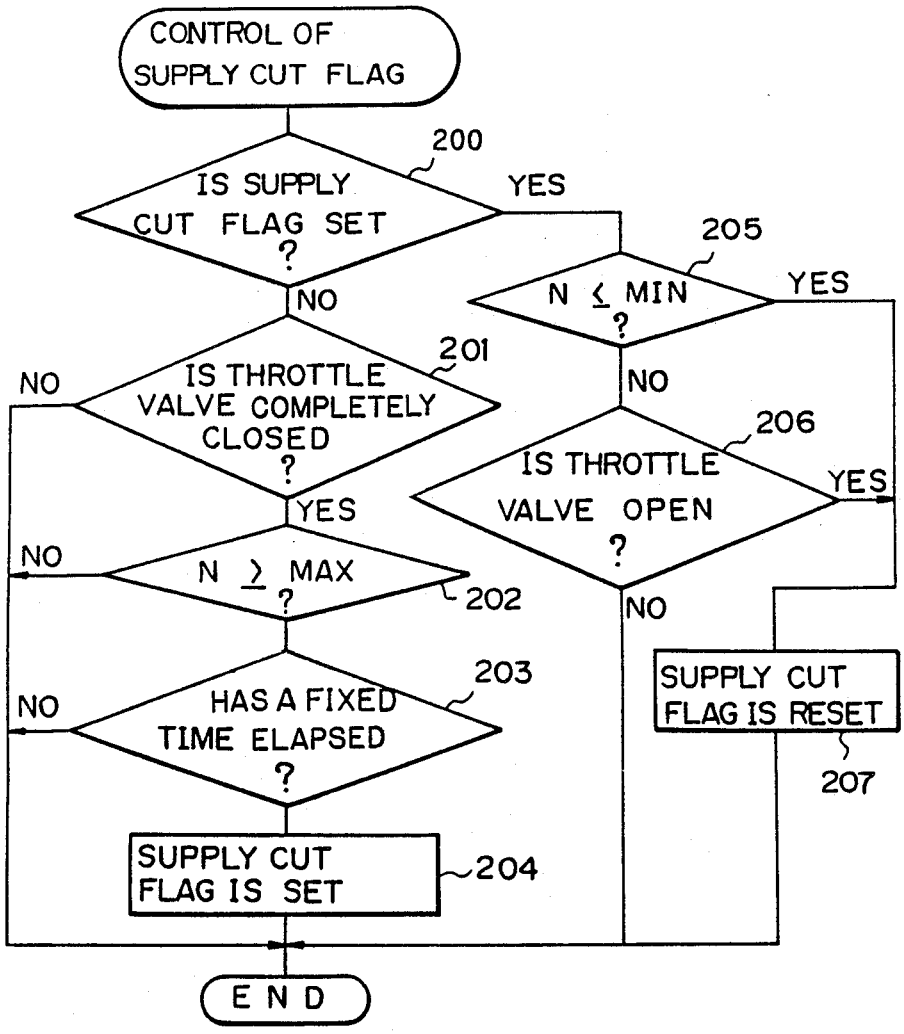
FIG. 9 is a flow chart for controlling the supply cut flag.

FIG. 9 illustrates a routine for controlling a supply cut flag used for stopping the supply of fuel at the time of deceleration, and this routine is processed by sequential interruptions executed at a predetermined timing.

Referring to FIG. 9, in step 200 it is determined whether or not the supply cut flag is set. Since the supply cut flag is normally reset, the routine goes to step 201 and it is determined on the basis of the output signal of the throttle switch 22 whether or not the throttle valve 15 is fully closed. If the throttle valve 15 is fully closed, the routine goes to step 202 and it is determined whether or not the engine speed N is higher than a predetermined supply cut speed MAX (FIG. 8). If $N \geqq MAX$, the routine goes to step 203 and it is determined whether or not a fixed time has elapsed. When the fixed time has elapsed, the routine goes to step 204 and the supply cut flag is set.

If the supply cut flag is set, the routine goes from step 200 to step 205 and it is determined whether or not the engine speed N is lower than a predetermined resume speed MIN (FIG. 8). If $N \leqq MIN$, the routine goes to step 207 and the supply cut flag is reset. Conversely, if $N > MIN$, the routine goes to step 206 and it is determined, on the basis of the output signal of the throttle switch 22, whether or not the throttle valve 15 is open. If the throttle valve 15 is open, the routine goes to step 207 and the supply cut flag is reset.

Namely, as illustrated in FIG. 8, when the throttle valve 15 is fully closed, if the engine speed N is higher than the supply cut speed MAX it is determined that the decelerating operation is carried out, and when the fixed time t has elapsed, the supply cut flag is set. As hereinafter described, if the supply cut flag is set, the supply of fuel is stopped, and thereafter, when the engine speed N becomes lower than the resume speed MIN, or when the throttle valve 15 is open, the supply cut flag is reset, and thus the supply of fuel is again started.

Figure 10:
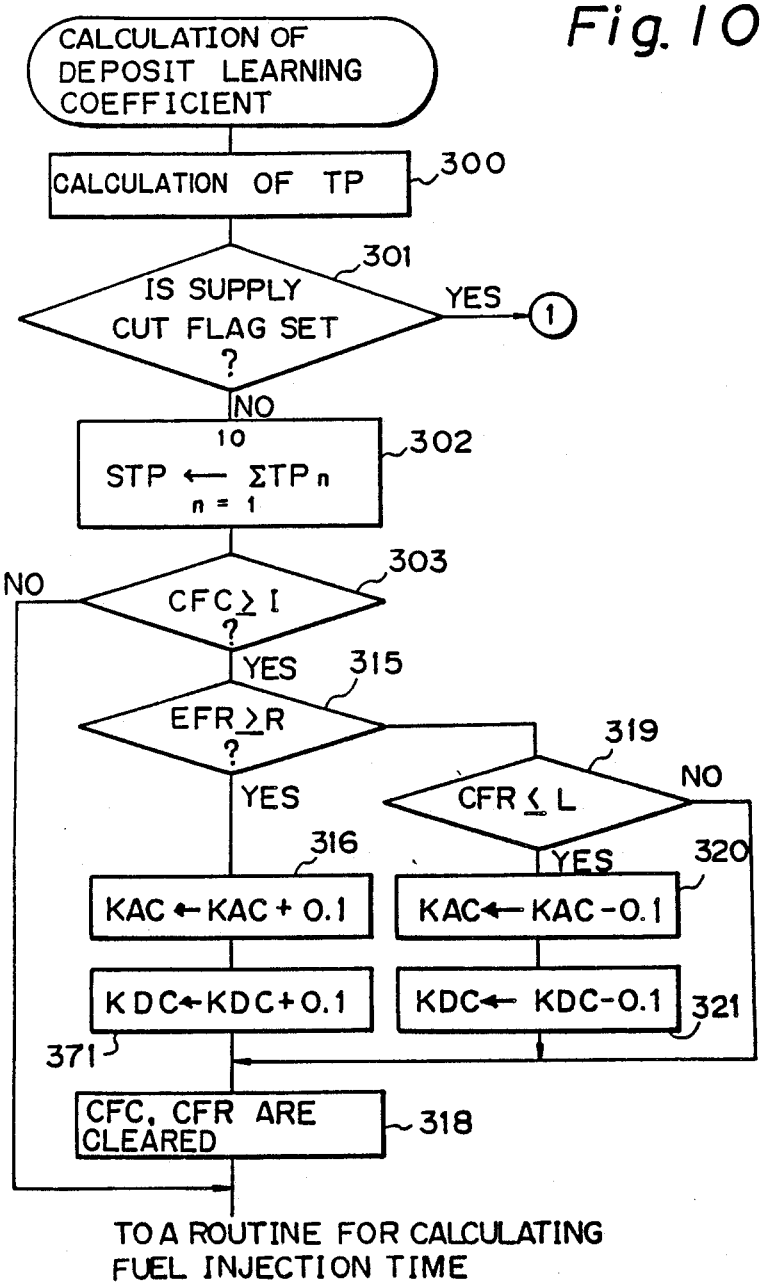
FIG. 10 and 11 are a flow chart for calculating the deposit learning coefficient.
Figure 11:
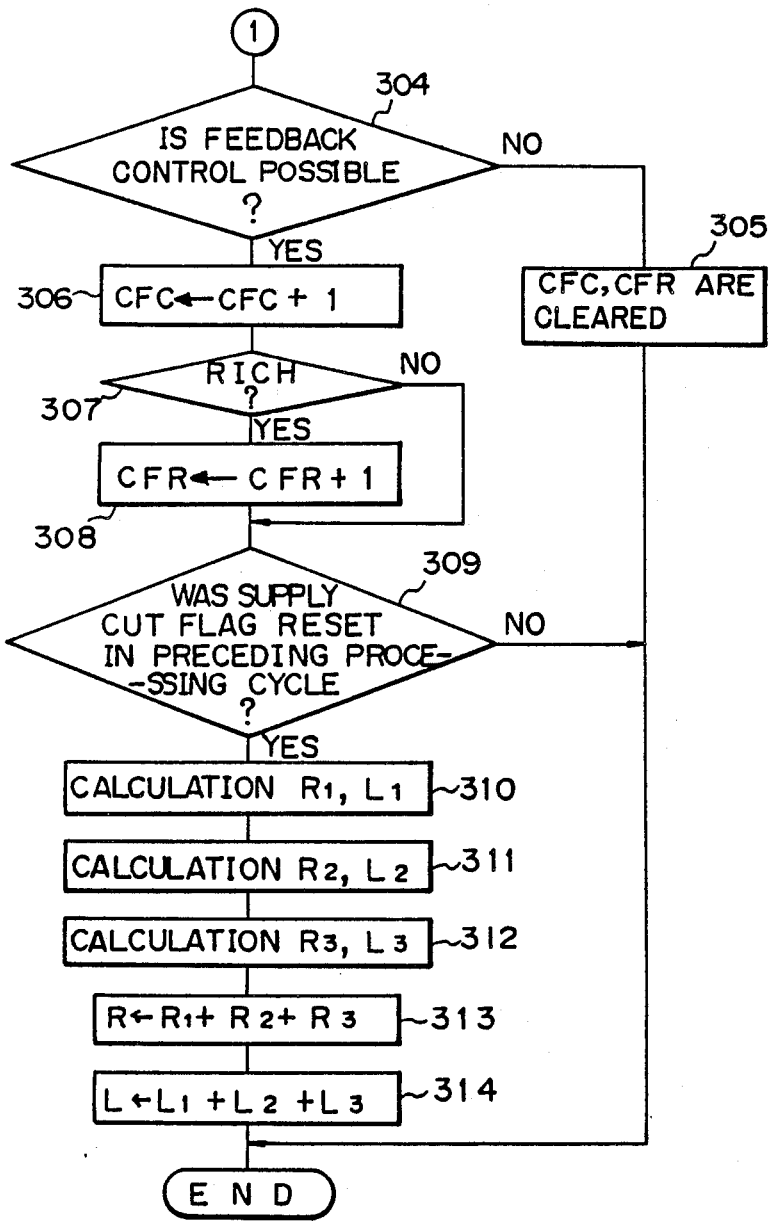

FIGS. 10 and 11 illustrate a routine for calculating the deposit learning coefficient K. This routine is processed by sequential interruptions executed at every rotation of the crankangle of 360 degrees.

Referring to FIGS. 10 and 11, in step 300 the basic fuel injection time TP is calculated on the basis of the output signals of the absolute pressure sensor 21 and the engine speed sensor 23. Then in step 301 it is determined whether or not the supply cut flag is set. When the supply cut flag is reset, i.e, when the supply of fuel is not to be stopped, the routine goes to step 302 and the sum STP of the past ten basic fuel injection times TP including the present fuel injection time TP is calculated. Then, in step 303 it is determined whether or not the count value of the counter CFC is larger than a predetermined fixed value I. Since this counter CFC is normally cleared, the flow goes to a routine for calculating the fuel injection time.

Conversely, if it is determined in step 301 that the supply cut flag is set, the routine goes to step 304 in FIG. 11 and it is determined whether or not the $O_2$ sensor 19 is activated to an extent such that the feedback operation of the air-fuel ratio can be carried out. If the feedback control can not be carried out, the routine goes to step 305 and the counters CFC and CFR are cleared, which completes the processing cycle. Conversely, if the feedback control can be carried out, the routine goes to step 306 and the count value of the counter CFC is incremented by one. Then, the routine goes to step 307 and it is determined, on the basis of the output signal of the $O_2$ sensor 19, whether or not the air-fuel mixture is rich. If the air-fuel mixture is lean the routine goes to step 309, and if the air-fuel mixture is rich the routine goes to step 308. In step 308, the count value of the counter CFR is incremented by one, and the routine then goes to step 309. Consequently, as illustrated in FIG. 9, if the supply cut flag is set, the counter CFC is continuously counted up, and the counter CFR is counted up only during the time that the air-fuel mixture is rich. Namely, the count value of the counter CFR represents the rich time.

In step 309, it is determined whether or not the supply cut flag was reset in the preceding processing cycle, i.e., the supply cut flag is set in the present processing cycle. If the supply cut flag was also set in the preceding processing cycle, the processing cycle is completed. Conversely, if the supply cut flag is set in the present processing cycle, the routine goes to step 310, and the first basic times $R_1$, $L_1$ of the rich time are calculated. Then, in step 311 the second basic times $R_2$, $L_2$ of the rich time are calculated, and in step 312, the third basic times $R_3$, $L_3$ of the rich time are calculated. Then, in step 313 the sum of $R_1$, $R_2$ and $R_3$ is memorized as R, and in step 314 the sum of $L_1$, $L_2$ and $L_3$ is memorized as L.

As illustrated in FIG. 8, if the decelerating operation of the engine is started, when the fixed time t has elapsed the supply cut flag is set and the supply of fuel is stopped. Therefore, during this fixed time t, the correction of a decrease in the amount of fuel is carried out, and thereafter, when the supply of fuel is stopped the air-fuel mixture becomes rich and at this time, the rich time depends mainly on both the amount of the deposit and the amount of fuel which has been corrected. Namely, assuming that the amount of the deposit is fixed, when the decelerating decreasing rate of the amount of fuel is relatively low, i.e., when the amount of fuel which has been corrected is relatively large, the rich time becomes long. At this time, since the accelerating increasing rate of the amount of fuel is also relatively low it can be considered that the air-fuel mixture will become lean at the time of acceleration. Conversely, assuming that the amount of fuel which has been corrected is fixed, the rich time becomes longer as the amount of the deposit becomes larger. When the rich time becomes longer, it can be considered that the air-fuel mixture has become lean at the time of acceleration. The above-mentioned R indicates the lower limit of the rich time wherein it is considered that the air-fuel mixture becomes lean at the time of acceleration.

On the other hand, assuming that the amount of the deposit is fixed, when the decelerating decreasing rate of the amount of fuel is relatively high, i.e., when the amount of fuel which has been corrected is relatively small, the rich time becomes short. At this time, since the accelerating increasing rate of the amount of fuel is also relatively high, it can be considered that the air-fuel mixture will become rich at the time of acceleration. Conversely, assuming that the amount of fuel which has been corrected is fixed, the rich time becomes short as the amount of the deposit becomes small. When the rich time becomes short, it can be considered that the air-fuel mixture has become rich at the time of acceleration. The above-mentioned L indicates the upper limit of the rich time wherein it is considered that the air-fuel mixture becomes rich at the time of acceleration. As mentioned above, although the lower limit R and the upper limit L of the rich time depend mainly on both the amount of the deposit and the amount of fuel which is corrected at the time of deceleration, these limits R, L are influenced by other factors. This influence is indicated by $R_1$, $L_1$, $R_2$, $L_2$, $R_3$, $L_3$ in steps 310, 311, 312 in FIG. 11.

Namely, even if the amount of the deposit and the decelerating decreasing rate of the amount of fuel are fixed, the rich time becomes longer as the amount of fuel injected by the fuel injector before the supply of fuel is stopped becomes larger. The STP calculated in step 302 indicates the amount of fuel injected before the supply of fuel is stopped, and thus as illustrated in FIG. 13(A), the lower limit $R_1$ and the upper limit $L_1$ of the first basic time are increased as the STP becomes larger.

In addition, where the amount of the deposit and the decelerating decreasing rate of the amount of fuel are fixed, the actual rich time is little changed by a change in the engine speed N, but since the routine illustrated in FIGS. 10 and 11 is executed every 360 degrees rotation of the crankangle, even if the actual rich time is fixed, the count value of the counter CFR, which represents the rich time, becomes larger as the engine speed N becomes higher. Therefore, as illustrated in FIG. 13(B), the lower limit $R_2$ and the upper limit $L_2$ of the second basic time are increased as the engine speed N becomes higher.

In addition, the amount of vaporization of the liquid fuel per unit of time becomes smaller as the absolute pressure PM in the surge tank 11 becomes higher. Consequently, as the absolute pressure PM becomes higher the liquid fuel continues to be vaporized for a longer time, and thus the rich time becomes longer. Therefore, as illustrated in FIG. 13(C), the lower limit $R_3$ and the upper limit $L_3$ of the third basic time are increased as the absolute pressure PM becomes higher.

Figure 13A:
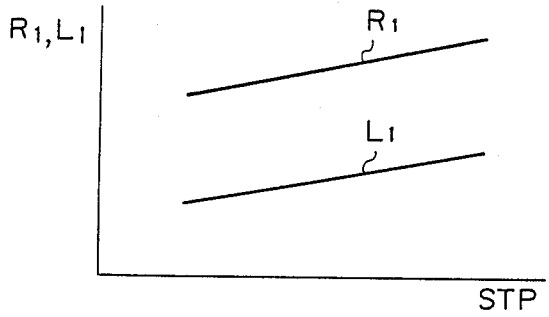
FIGS. 13(A)–13(C) show diagrams illustrating the various basic times for the rich time.
Figure 13B:
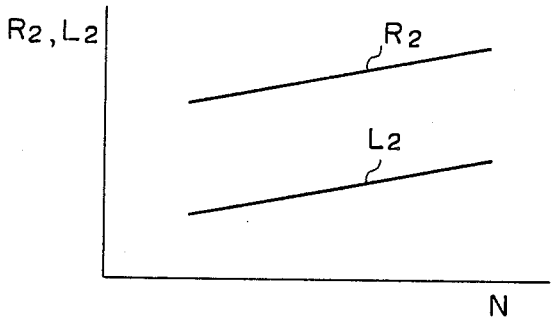
Figure 13C:
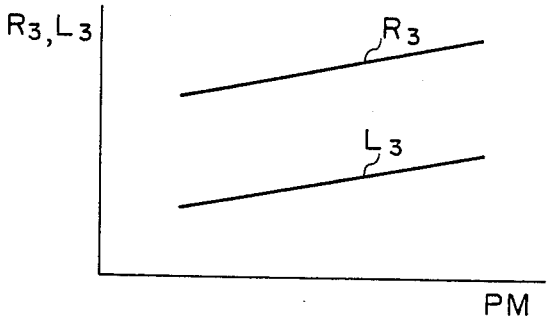

The relationships illustrated in FIGS. 13(A), (B) and (C) are stored in the ROM 32 and, therefore, in steps 310, 311 and 312, $R_1$, $L_1$, $R_2$, $L_2$, $R_3$ and $L_3$ are calculated from the relationships stored in the ROM 32.

As mentioned above, when the supply cut flag is set in the present processing cycle, the lower limit L and the upper limit R are obtained in steps 313, 314, in the next processing cycle the routine is completed via step 309, and at this time, the supply of fuel remains stopped.

Turning to FIG. 10, when the supply cut flag is reset after the supply of fuel is stopped, the routine goes from step 301 to step 303 via step 302. At this time, if the count value of the counter CFC exceeds the fixed value I (FIG. 8), i.e., if the supply of fuel remains stopped for more than a fixed time, the routine goes to step 315 and it is determined whether or not the count value of the counter CFR is larger than the lower limit R (FIG. 8). As mentioned above, $CFR \geqq R$ means that the air-fuel mixture becomes lean at the time of acceleration, Consequently, if $CFR \geqq R$, the routine goes to step 316 and a fixed value, or example, 0.1, is added to the acceleration correction coefficient KAC. Then, at step 317 a fixed value, for example, 0.1, is added to the deceleration correction coefficient KDC, and in step 318 the counters CFC and CFR are cleared.

Conversely, if $CFR < R$, the routine goes to step 319 and it is determined whether or not the count value of the counter CFR is smaller than the upper limit L (FIG. 8). As mentioned above, $CFR \leqq L$ means that the air-fuel mixture becomes rich at the time of acceleration. Consequently, if $CFR \leqq L$, the routine goes to step 320 and a fixed value, for example, 0.1, is subtracted from the acceleration correction coefficient KAC. Then in step 321 a fixed value, for example, 0.1, is subtracted from the deceleration correction coefficient KDC, and in step 318 the counters CFC and CFR are cleared. If $R > CFR > L$, KAC and KDC are maintained without change. After the counters CFC and CFR are cleared in step 318, the flow goes to the routine for calculating the fuel injection time, and thus, if the supply cut flag is reset, the fuel injecting operation is started again.

Figure 12:
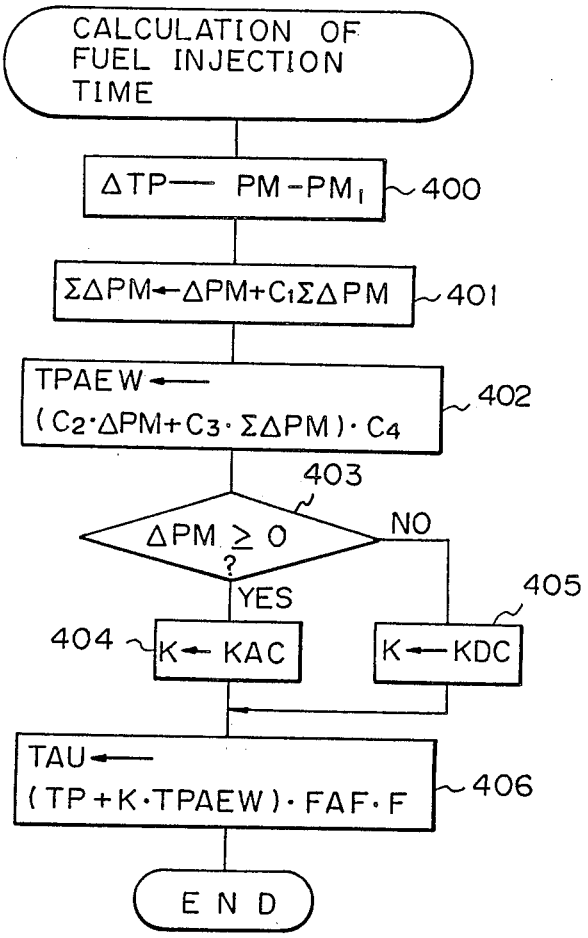
FIG. 12 is a flow chart for calculating the fuel injection time.

FIG. 12 illustrates a routine for calculating the fuel injection time, which is executed successively after the execution of the routine illustrated in FIG. 10.

Referring to FIG. 12, in step 400, the absolute pressure $PM_1$ in the surge tank 11, which is detected by the absolute pressure sensor 21 in the preceding processing cycle, is subtracted from the present absolute pressure PM in the surge tank 11, and the result of the subtraction ΔPM is memorized as a rate of change of the absolute pressure ΔPM. Then, in step 401 ΣΔPM is calculated from the following equation.

$$\Sigma\Delta PM = \Delta PM + C_1 \Sigma\Delta PM \quad (5)$$

Then in step 402 the correction fuel injection time TPAEW is calculated from the following equation.

$$TPAEW = (C_2 \cdot \Delta PM + C_3 \cdot \Sigma\Delta PM) \cdot C_4 \quad (6)$$

If the above equations (5) and (6) are combined, the resulting equation becomes as follows.

$$TPAEW = \{C_2 \cdot \Delta PM + C_3 \cdot (\Delta PM + C_1 \Sigma\Delta PM)\} \cdot C_4$$

This equation represents the above-mentioned equation (3), and thus represents an increase or a reduction in the amount of fuel necessary to maintain the air-fuel ratio of the mixture at the stoichiometric air-fuel ratio in a transition operating state where a deposit is not adhered to the inner wall of the intake port, etc.

Then, in step 403 it is determined whether or not ΔPM is positive or equal to zero. When it is determined in step 403 that ΔPM is equal to zero, or it is determined that ΔPM is positive, i.e., the accelerating operation of the engine is carried out, the routine goes to step 404 and the acceleration correction coefficient KAC is memorized as the correction coefficient K. Then the routine goes to step 406. Conversely, when it is determined in step 403 that ΔPM is negative, i.e., the decelerating operation of the engine is carried out, the routine goes to step 405 and the deceleration correction coefficient KDC is memorized as the correction coefficient K. Then the routine goes to step 406.

In step 406, the fuel injection time TAU is calculated from the following equation.

$$TAU = (TP + K \cdot TPEAW) \cdot FAF \cdot F$$

When the supply of fuel is stopped at the time of deceleration, if the rich time exceeds the lower limit due to the presence of the deposit, the correction coefficient K is increased. Consequently, when the accelerating operation is carried out, since K·TPAEW, i.e., the acceleration increasing rate of the amount of fuel is increased, the air-fuel ratio of the mixture is maintained at the stoichiometric air-fuel ratio. Conversely, if the correction coefficient K is increased as mentioned above, when the next decelerating operation is carried out, since K·TPAEW, i.e., the deceleration reducing rate of the amount of fuel is increased, the air-fuel ratio of the mixture is maintained at the stoichiometric air-fuel ratio. Therefore, even if the deposit is adhered to the inner wall of the intake port, etc., it is possible to maintain the air-fuel ratio of the mixture at the stoichiometric air-fuel ratio regardless of the operating state of the engine. The above-mentioned acceleration correction coefficient KAC and deceleration correction coefficient KDC are stored in the back-up RAM 33*a*.

When the supply of fuel is stopped, various patterns of the engine operation do not exist, as in the accelerating operation of the engine, and the engine operating pattern becomes uniform. Consequently, at this time, the rich time correctly indicates the state of the deposit. Therefore, by controlling the accelerating increasing rate of the amount of fuel on the basis of the rich time, it is possible to maintain the air-fuel ratio of mixture at the stoichiometric air-fuel ratio at the time of acceleration.

While the invention has been described by reference to a specific embodiment chosen for purposes of illustration, it should be apparent that numerous modifications could be made thereto by those skilled in the art without departing from the basic concept and scope of the invention.

We claim:

1. A fuel injection control device of an engine having an intake passage and an exhaust passage, said device comprising:

an oxygen concentration detector arranged in the exhaust passage and producing an output signal indicating whether an air-fuel mixture fed into the engine is lean or rich;

feedback control means for controlling an amount of fuel fed into the engine in response to the output signal of said oxygen concentration detector to bring an air-fuel ratio of the mixture to a desired air-fuel ratio;

acceleration detecting means for detecting an accelerating operation of the engine;

fuel increasing means for increasing the amount of fuel fed into the engine when the accelerating operation of the engine is carried out;

deceleration detecting means for detecting a decelerating operation of the engine;

fuel supply stopping means for stopping a supply of fuel into the engine when the decelerating operation of the engine is carried out;

time calculating means for calculating a rich time of the air-fuel mixture on the basis of the output signal of said oxygen concentration detector during the time for which the supply of fuel is stopped; and correction means for correcting an increase in the amount of fuel, which increase is caused by said fuel increasing means, to increase said increase in the amount of fuel when said rich time is longer than a predetermined first time and to reduce said increase in the amount of fuel when said rich time is shorter than a predetermined second time which is shorter than said first predetermined time.

2. A fuel injection control device according to claim 1, wherein said time calculating means calculates said rich time only when said supply of fuel remains stopped for longer than a predetermined time.

3. A fuel injection control device according to claim 1, wherein said time calculating means begins to calculate said rich time immediately after said supply of fuel is stopped.

4. A fuel injection control device according to claim 1, wherein said supply of fuel is stopped when a fixed time has elapsed after the decelerating operation of the engine is started.

5. A fuel injection control device according to claim 1, wherein said first predetermined time and said second predetermined time are changed in accordance with the amount of fuel fed immediately before said supply of fuel is stopped.

6. A fuel injection control device according to claim 5, wherein said first predetermined time and said second predetermined time are prolonged as the amount of fuel fed immediately before said supply of fuel is stopped is increased.

7. A fuel injection control device according to claim 5, wherein the amount of fuel fed immediately before said supply of fuel is stopped is an average of the amount of fuel fed many times immediately before said supply of fuel is stopped.

8. A fuel injection control device according to claim 1, wherein said time calculating means determines whether or not the air-fuel mixture is rich at a predetermined crankangle, to calculate said rich time.

9. A fuel injection control device according to claim 8, wherein said first predetermined time and said second predetermined-time are changed in accordance with a change in engine speed.

10. A fuel injection control device according to claim 9, wherein said first predetermined time and said second predetermined time are prolonged as the engine speed becomes higher.

11. A fuel injection control device according to claim 1, wherein said first predetermined time and said second predetermined time are changed in accordance with a change in an absolute pressure in the intake passage.

12. A fuel injection control device according to claim 11, wherein said first predetermined time and said second predetermined time are prolonged as said absolute pressure in the intake passage becomes higher.

13. A fuel injection control device according to claim 1, wherein said increase in the amount of fuel by said fuel increasing means is increased for a short time after the accelerating operation of the engine is started, and a reduction in said increase in the amount of fuel is begun after said short time has elapsed and continues even after the accelerating operation of the engine is completed.

14. A fuel injection control device according to claim 13, wherein said increase in the amount of fuel is controlled on the basis of a rate of change of an engine load, and said increase in the amount of fuel is increased when said rate of change is relatively high, said increase in the amount of fuel being reduced when said rate of change is relatively low.

15. A fuel injection control device according to claim 14, wherein said engine load is represented by an absolute pressure PM in the intake passage.

16. A fuel injection control device according to claim 14, wherein said increase in the amount of fuel is calculated from the following equation.

$$TPAEW=\{C_2\cdot\Delta L+C_3\cdot(\Delta L+C_1\cdot\Sigma\Delta L)\}\cdot C_4$$

where

TPAEW: said increase in the amount fuel $\Delta L$: said rate of change of the engine load $C_1$, $C_2$, $C_3$, $C_4$ coefficients,

17. A fuel injection control device according to claim 16, wherein said correction means corrects said TPAEW.

18. A fuel injection control device according to claim 1, wherein said fuel supply stopping means stops said supply of fuel only when the decelerating operation of the engine is at a predetermined operation state.

19. A fuel injection control device according to claim 18, wherein said predetermined operation state is a state wherein an engine speed is higher than a predetermined speed when the decelerating operation of the engine is started.

20. A fuel injection control device according to claim 18, further comprising: fuel decreasing means for decreasing the amount of fuel fed into the engine when the decelerating operation of the engine in a state other than said predetermined operation state is carried out; and correction means used during a deceleration operation for correcting a decrease in the amount of fuel, which decrease is caused by said fuel decreasing means, to increase said decrease in the amount of fuel when said rich time is longer than said first predetermined time and to reduce said decrease in the amount of fuel when said rich time is shorter than said second predetermined time.

21. A fuel injection control device according to claim 20, wherein said decrease in the amount of fuel by said fuel decreasing means is increased for a short time after the decelerating operation of the engine is started, and a reduction in said decrease in the amount of fuel is begun after said short time has elapsed and continues even after the decelerating operation of the engine is completed.

22. A fuel injection control device according to claim 21, wherein said decrease in the amount of fuel is controlled on the basis of a rate of change of an engine load, and said decrease in the amount of fuel is increased when said rate of change is relatively high, and said decrease in the amount of fuel is reduced when said rate of change is relatively low.

23. A fuel injection control device according to claim 22, wherein said engine load is represented by an absolute pressure PM in the intake passage.

24. A fuel injection control device according to claim 22, wherein said decrease in the amount of fuel is calculated from the following equation.

$$TPAEW=\{C_2\cdot\Delta L+C_3\cdot(\Delta L+C_1\cdot\Sigma\Delta L)\}C_4$$

Where

TPAEW: said decrease in the amount of fuel $\Delta L$: said rate of change of the engine load $C_1$, $C_2$, $C_3$, $C_4$: coefficients.

25. A fuel injection control device according to claim 24, wherein said correction means used during a deceleration operation corrects said TPAEW.

* * * * *